US005716567A

United States Patent [19]

Musina et al.

[11] Patent Number: 5,716,567

[45] Date of Patent: Feb. 10, 1998

[54] PROCESS FOR PRODUCING POLYIMIDE FIBER

[75] Inventors: Tamara Kurmangazievna Musina, Moscow; Zinaida Grigorievna Oprits, Mytishi; Alexandr Mikhailovich Schetinin, Mytishi; Alexandr Ivanovich Andriashin, Mytishi; Ruslan Rustemovich Musin, Sankt-Peterburg, all of Russian Federation

[73] Assignee: Tamara Kurmangazievna Musina, Moscow, Russian Federation

[21] Appl. No.: 682,502

[22] PCT Filed: Nov. 30, 1994

[86] PCT No.: PCT/RU94/00266

§ 371 Date: Jul. 9, 1996

§ 102(e) Date: Jul. 9, 1996

[87] PCT Pub. No.: WO96/04414

PCT Pub. Date: Feb. 15, 1996

[30] Foreign Application Priority Data

Aug. 1, 1994 [RU] Russian Federation ..... 94028715

[51] Int. Cl.[6] ..... D01D 5/06; D01F 6/74

[52] U.S. Cl. ..... 264/101; 264/184; 264/210.5; 264/210.8; 264/211.15; 264/211.16; 264/233

[58] Field of Search ..... 264/101, 184, 264/210.5, 210.8, 211.14, 211.15, 211.16, 233, 234

[56] References Cited

U.S. PATENT DOCUMENTS

| | | | |
|---|---|---|---|
| 3,179,614 | 4/1965 | Edwards | 524/726 |
| 3,415,782 | 12/1968 | Irwin | 264/210.5 X |
| 4,640,972 | 2/1987 | Irwin | 528/188 |
| 4,869,861 | 9/1989 | Inoue et al. | 264/210.8 X |

FOREIGN PATENT DOCUMENTS

| | | | |
|---|---|---|---|
| 119185 | 1/1989 | European Pat. Off. . | |
| 2829811 | 1/1980 | Germany . | |
| 59-163416 | 9/1984 | Japan . | |
| WO94/25649 | 11/1994 | WIPO | 264/211.16 |

*Primary Examiner*—Leo B. Tentoni
*Attorney, Agent, or Firm*—Collard & Roe, P.C.

[57] ABSTRACT

A process for the production of polyimide fibers includes having the fiber spun from a fully aromatic polyamide acid solution in an aprotic amide solvent in an aqueous-organic bath and subjected to plasticization drafting. It is washed until a 2–4 wt. % content of the organic solvent per fiber is attained and treated with organic or inorganic acids until a 0.5–1.0 wt. % content thereof per fiber is attained. Thereafter, fibers are dried and heat-treated.

5 Claims, No Drawings

PROCESS FOR PRODUCING POLYIMIDE FIBER

BACKGROUND OF THE INVENTION

1. Field of the Invention

The present invention relates to the process for production of aromatic polyimide fibres featuring high fire- and heat-resistance, and can be used for making products that are to operate, partly or completely, in a direct contact with an open fire, or are subjected to a thermal shock at a temperature of from 700° to 1200° C., or wherever it is impermissible to release into the atmosphere the polymer destruction products or fume particles resulting from local overheating of textile materials.

Improved-quality polyimide fibres are made use of for making:

- materials for special protective clothing and other individual protection means for firemen and members of search-and-rescue crews, those of crews of aircraft and sea vessels, workers of the gas, oil, coal, and metallurgical industries, as well as those of some other services concerned with fire hazard and contact with a naked flame;
- upholstery, decorative-finishing, heat-insulation woven and bonded fabrics, fire-resistant cords, ropes, cables, and so on;
- sunk-loop fabrics in which the top layer consists of nap, plush, bonded fabric, knitted fabric from polyimide fibres or threads, and the bottom layer consists of any other natural or man-made fibre.

The top layer protects completely against an open fire and thermal shock, while the bottom layer provides for other properties, such as comfort when using natural fibres. Moreover, the chemisorption ability of the polyimide fibres enables such sunk-loop fabrics to be used for making masks and caps protecting the respiratory system and the organ of vision against fumes and combustion products when evacuating people from the zone of accidental fires in public places (such as hotels, saloons of sea vessels, production and public-amenity premises).

High level of thermal stability of polyimide materials enables one to use them to good advantage in extra-reliable filtering units operating at 250°–350° C., as well as in articles adapted to operate at such temperatures in the open air.

2. The Prior Art

According to a state-of-the-art process for producing polyimide fibres, polyamide acid is synthesized from pyromellitic dianhydride and 4,4'-diaminodiphenylmethane or metaphenylenediamine in a dimethyl- formamide solution, followed by a wet spinning in an aqueous-settling bath, whereupon the freshly spun fibres are subjected to plasticization drafting and heat-treatment (cf., e.g., U.S. Pat. No. 3,179,614, C1. 524–726, published in 1965).

However, the fibres produced by the method discussed before features but low mechanical characteristics (that is, their strength is as low as 25–27 cN/tex) and low thermal stability.

Higher consumer's and service properties are displayed by the polyimide fibres produced on the base of pyromellitic dianhydride and 4,4'-diaminodiphenyloxide. Such a polyimide fibre is produced by a wet spinning of a concentrated solution of said polyamide acid in N-methylpyrrolidone, followed by plasticization drafting, chemical and thermal imidization; it has a strength of 55 cN/tex, an elastic modulus of 1280 kgf/sq.mm, and a percentage elongation at rupture of 7% (cf., e.g., Japanese Application 59-163,416, C1. DO1F 6/74 published in 1984).

The fibre produced by the aforedescribed process has an oxygen index of 36%; however, its thermal stability is also low, that is, after having been heated at 300° C. for 100 hours, the fibre loses 35–45% of its initial strength.

The polyimide fibres of the aforespecified chemical structure are produced by dry spinning of an appropriate polyamide acid in a dimethylformamide solution, followed by thermal imidization (cf., e.g., U.S. Pat. No. 3,415,782, C1. 260-47, published in 1968).

The fibre has a strength of about 60 cN/tex and an oxygen index of 35%. After having been heat in the air at 300° C. for 100 hours the fibre loses 40–42% of its initial strength.

A most similar to the present invention is a process for producing polyimide fibres from polyamide acid of the following general formula:

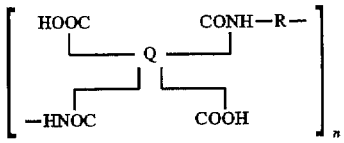

where Q is the residue of the dianhydrides of pyromellitic, 3,3',4,4'- diphenyltetracarboxylic, 3,3',4,4'-diphenyloxidetetracarboxylic, and 3,3',4,4'-benzophenonetetracarboxylic acids, hydroquinone-bis-(3,4-dicarboxyphenyl) ester, resorcinol-bis-(3,4-dicarboxyphenyl) ester, and paraphenylene-bis-trimellitate;

R is the residue of paraphenylenediamine, benzidine, 4,4'-diaminoparaterphenyl, 2,7-diaminofluorene, 2,7-diaminofluorenone, or 2,8-diaminophenoxathein.

The process consists in that a polyamide acid solution is prepared in an aprotic organic solvent in the course of synthesis. Used as solvents are aprotic organic solvents, such as dimethylformamide, dimethylacetamide, dimethylsulfoxide, diethylformamide, and N-methyl- pyrrolidone. According to the process, said polyamide acid solution is subjected to spinning in an aqueous-organic settling baths whereupon the freshly spun fibres are subjected to plasticization drafting, washed, dried, and heat-treated in an inert medium at a temperature of the order of 350°–600° C. (cf. FRG Application 2,829,811, C1.D01F 6/74, 1980).

The strength of the thus-produced fibres is as high as 140 cN/tex, their elastic modulus being 13000 kgf/sq,mm; however, as to the resistance of such fibres to the effect of high temperatures and open fire they do not excel conventional polyimide fibres (Table 1).

SUMMARY OF THE INVENTION

The present invention has for its principal object not only to impart to polyimide fibres resistance to a thermal shock at a temperature of 700°–800° C., operating reliability in an atmosphere with an increased oxygen content (40–70%) and during a direct contact with open fire, and thermal stability against the effect of high temperatures but also uniformity and steadiness of the aforesaid properties.

As far as the process for producing polyimide fibres is concerned, the foregoing object is accomplished due to the fact that the fibre spun from a solution of a fully aromatic polyamide acid having the aforementioned structure, in an aprotic amide solvent in an aqueous-organic bath and subjected to plasticization drafting, is washed till a 2–4 wt. % content of the organic solvent therein, and treated with phosphoric, boric, hydrochloric acid, or else with an organic acid, such as benzoic, nicotinic, or iso-nicotinic until a 0.5–1.0 wt. % of the solvent per fibre is attained.

Used as solvents are anhydrous aprotic amide solvents, viz, dimethylacetamide, dimethylformamide, or N-methylpyrrolidone. Then the fibre is dried and subjected to a double-stage heat-treatment in an intermittent process, that is, the first stage in an atmospheric air, and the second stage, under vacuum, or in a continuous process by passing the fibre through two or more tubes. The inlet temperature of the second tube is 250°–300° C., the outlet temperature being 500°–900° C.. The atmosphere in the tube is inert. The traversing speed of the fibre through the heated zone is 30–100 m/min. The tension of the fibre during heat-treatment in the second tube is 5–15 cN/tex. The inlet temperature of the first tube is 30°–60° C., its outlet temperature being 200°–250° C. The medium is atmospheric air.

As far as polyimide fibres produced by the proposed process are concerned, the foregoing object is accomplished due to the provision of a fibre having a low-strain relaxed morphological structure. The molecular chain comprises the elements that enhance much the resistance of fibrous materials to the effect of open fire and to thermal-oxidative break-down.

The resultant polyimide systems, unlike conventional fibrous materials, are endowed with quite novel properties, such as chemisorption.

The hereinproposed fibres are based on fully aromatic polyimides of the following general formula:

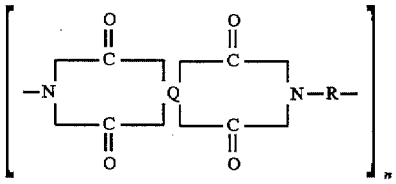

where n=80–300;

Q is the residue of one or more tetracarboxylic acids selected from the group consisting of pyromellitic, diphenyltetracarboxylic, diphenyloxidetetracarboxylic, and benzophenonetetracarboxylic acids, hydroquinone-bis-(3,4-dicarboxyphenyl) ester, resorcinol-bis-(3,4-dicarboxyphenyl) ester, or paraphenylene-bis-trimellitate;

R is the residue of one or more diamines, in particular, paraphenylenediamine, metaphenylenediamine, 4,4'-diaminodiphenylmethane, 4,4'-diaminodiphenylsulfide, 2,7-diaminofluorene, 2,7-diaminofluorenone, and 2,8-diaminophenoxazine, as well as diamines containing azole groups.

By and large, those polyimides are also preferable in which Q is a derivative of one of the tetracarboxylic acids, i.e., pyromellitic, 3,3',4,4'-diphenyltetracarboxylic, 3,3',4,4'-benzophenonetetracarboxylic, and 3,3',4,4'-diphenyloxidetetracarboxylic, and R is paraphenylenediamine, metaphenylenediamine, 4,4'-diaminodiphenyloxide, 4,4'diamino- diphenylmethane, 4,4'-diaminodiphenylsulfide, and diamines containing diazole groups.

It is due to the fact that phosphoric, boric, hydrochloric, and organic acids (viz, benzoic, nicotinic, and iso-nicotinic) are not only "mild" catalysts of the imidization process but at the final stages of said process said acids and their derivatives are "built into" the polyimide chain, that the entire macromolecule acquires chemosorptive properties with a cation activity. In this case the terminal carboxyls turn into anhydride groups, and the mobile terminal amino group is blocked by the catalyst according to the salt-formation mechanism, which enhances much the thermal stability of the fibres produced, as well as adds to uniformity and steadiness of their properties. The presence of phosphorus fragments even in small amounts increases abruptly fire-resistance of textile materials and their resistance to a thermal shock.

DETAILED DESCRIPTION OF PREFERRED EMBODIMENTS

In what follows the present invention is illustrated by the following examples.

EXAMPLE 1

A solution of 4,4'-diaminodiphenyloxide in dimethylacetamide is prepared in a temperature-controlled reactor under constant stirring. Once the dissolving has terminated, a temperature of 16±2° C. is maintained in the reactor, whereupon an equimolar quantity of anhydrous pyromellitic acid dianhydride is added to the solution in three portions. The result of the polycondensation reaction is a viscous solution of polyamide acid having a concentration of 12.8 wt. %. Dynamic viscosity of the solution at 20° C. is 42.5 Pa.s. Next the resultant solution is passed through a filter and deaerated.

Fibre is subjected to spinning by the wet technique into an aqueous-dimethylacetamide settling bath at a temperature of 20°+2° C. through a spinneret having 100 spinning openings 0.08 mm in diameter. The freshly spun fibre is drafted in the air by 150%, after which the fibre is washed with desalinized water in such a manner that one of the specimens is washed off completely, while the other specimen retains 3.55 wt. % of the solvent.

Then the specimens are treated with a modifying solution containing ottophosphoric acid, and dried in a vacuum drier at 50°–60° C.

As a result of all operations performed, there are produced three specimens of the polyamide-acid fibres:

A—the fibre contains neither solvent nor catalyst;

B—the fibre contains 0.52 wt. % of phosphorus; and

C—the fibre contains 0.51 wt. % of phosphorus and 3.52 wt. % of the residual solvent.

Heat-treatment of the fibres is carried in two heated tubes under the following process conditions:

First tube temperature: inlet—50° C., outlet—225° C.

Medium—atmospheric air

Inlet temperature of the second tube—286° C.

Outlet temperature of the second tube—550° C.

Second tube medium—nitrogen

Tension during treatment in the second tube—8 cN/tex

Traversing speed of fibres in the tubes—20 m/min.

EXAMPLE 2

Synthesis of polyamide acid, fibre production process, fibre plasticization drafting, washing, drying, and treatment are similar to Example 1.

The fibres are heat-treated in two heated tubes under the following conditions:

First tube temperature: inlet—50° C., outlet—225° C.

Medium—atmospheric air

Inlet temperature of the second tube—286° C.

Outlet temperature of the second tube—550° C.

Second tube medium—vacuum

Tension during treatment in the second tube—8 CN/tex

Traversing speed of fibres in the tubes—20 m/min.

EXAMPLE 3

A solution of 4,4'-diaminodiphenyloxide in dimethylacetamide is prepared in a reactor, the amount of 4,4'-diaminodiphenyloxide being 0.7 mole of the estimated. Once the dissolution has been completed, the mixture is cooled to a temperature of 16±2° C.

There is prepared separately an anhydrous mixture of an equimolar amount of the pyromellitic acid dianhydride and 0.3 mole of 5(6)-amino-2(n-aminophenyl)-benzimidazole. Then the thoroughly agitated mixture of said monomers are added, with the stirrer operating, to a solution of 4,4'-diaminodiphenyloxide. The reactor temperature rises to 300° C. In 45–90 min a viscous polyamide acid solution results, having a concentration of 11.5 wt. % and a dynamic viscosity of 43.0 Pa.s. After having been filtered and deaerated the solution is subjected to spinning as described in Example 1.

Three fibre types are obtained:

A—the fibre contains neither solvent nor catalyst;

B—the fibre contains 0.62 wt. % of phosphorus; and

C—the fibre contains 0.60 wt. % of phosphorus and 4.0 wt. % of the solvent.

EXAMPLE 4

A mixture of equimolar amounts of anhydrous pyromellitic acid dianhydride and 5(6)-amino-2(n-aminophenyl)-benzimidazole is added under constant stirring to dimethylacetamide cooled down to 160° C. The reactor temperature rises to 250° C. The result of the polycondensation reaction is a viscous solution with a 8.0 wt. % concentration of the respective polyamide acid and a dynamic viscosity of 45.1 Pa.s. Then the solution is subjected to spinning as in Example 1. and The as-spun fibre is drafted in the air by 110% and subjected to washing, impregnation with an ortophosphoric acid solution and drying to obtain the three fibre specimens as in Example 1:

A—the fibre contains neither solvent nor catalyst;

B—the fibre contains 1.0 wt. % of phosphorus; and

C—the fibre contains 0.98 wt. % of phosphorus and 3.1 wt. % of the solvent.

EXAMPLE 5

A solution of paraphenylenediamine in diamine is prepared in a stirrer-equipped reactor at a temperature of 200° C. Once the dissolution has been completed, a mixture of the dianhydrides of diphenyltetracarboxylic and pyromellitic acids is added to the solution in a molar ratio of 75:25%. In four hours a dark-colored viscous solution results, having a concentration of 8.9 wt. % and a dynamic. viscosity of 51.2 Pa.s. Then the solution is subjected to spinning in an aqueous-dimethylacetamide settling bath through a spinneret having 100 spinning openings 0.08 mm in diameter. The as-spun fibre is drafted in the air by 110% and subjected to washing, impregnation with an ortophosphoric acid solution and drying to obtain the three fibre specimens:

A—the fibre contains neither solvent nor catalyst;

B—the fibre contains 0.8 wt. % of phosphorus; and

C—the fibre contains 0.81 wt. % of phosphorus and 2.86 wt. % of the solvent.

Thermal imidization is carried out aS in Example 1 with the sole exception that the second tube outlet temperature is 650° C. and the tension equals 15 cN/tex.

EXAMPLE 6

A solution of 2,7-diaminofluorene in dimethylacetamide is prepared in a stirrer-equipped reactor, whereupon a constant temperature of 200° C. is set therein. Then an equimolar amount of anhydrous pyromellitic acid dianhydride is charged to the reactor batchwise. The result of the polycondensation reaction is a viscous polyamide acid solution with a concentration of 13.5 wt. % and a dynamic viscosity of 68.5 Pa.s. Next the solution is passed through a filter, deaerated, and subjected to spinning in an ethyleneglycol settling bath at 20° C. through a single-hole spinneret having a diameter of 0.54 mm. Thereupon the as-spun fibre is drafted in water at 20° C. by 150% and dried. One specimen (A) is thoroughly washed, whereas the other specimen (B) is washed until 3.55 wt. % of the solvent remains therein.

Both of the specimens are treated with an ortophosphoric acid solution until a phosphorus content of 0.8 wt. % is attained. Then the specimens are dried at 50° C. in a vacuum drier and subjected to heat-treatment under following conditions:

1. In an intermittent-action thermal ring formation unit in the medium of nitrogen or under vacuum at a temperature of 440° C. (see Table 2, Examples 6A1, 6A2).

2. According to a double-stage continuous heat-treatment process as in Example 5 (see Table 2, Example 6B).

The characteristics of the fibres are tabulated in Table 3.

Table 2 contains characteristics of the polyimide fibres produced according to Examples 1, 2, 3, 4, 5 and 6.

It can be seen from Table 2 that use of the proposed invention enables one to enhance the thermal-mechanical characteristics of the fibres and to add to the stability of their properties.

The values of the factors of stability of the properties as for strength, percentage elongation, elastic modulus, oxygen index, and thermal stability are presented in Table 4.

TABLE 1

Mechanical properties and heat stability of polyimide fibres as disclosed in FRG Application 2,829,811 (the prototype)

| | Initial monomers | | Strength, |
|---|---|---|---|
| Number | Acid component | Diamine | cN/tex |
| 1 | Piromellitic dianhydride | 2,7-Diamino-fluorene | 110/140 |
| 2 | 3,3',4,4'-Diphenyl-oxidetetracarboxylic acid dianhydride | Paraphenylene-diamine | 140/160 |
| | | Benzidine | 115 |
| | | 2,7-Diamino-fluorene | 85 |
| 3 | 3,3',4,4'-Benzo-phenonetetra-carboxylic acid dianhydride | Benzidine | 95 |
| | | Paraphenylene-diamine | 85 |
| 4 | 3,3',4,4'-Diphenyl-tetracarboxylic acid dianhydride | Benzidine | 92 |
| 5 | Hydroquinone-bis--(3,4-dicarboxy-phenyl) ester dianhydride | 2,7-Diamino-fluorenone | 120 |
| 6 | Paraphenylene-bis- | 2,8-Diamino- | 150 |

TABLE 1-continued

| Mechanical properties and heat stability of polyimide fibres as disclosed in FRG Application 2,829,811 (the prototype) | | | |
|---|---|---|---|
| | -trimellitate dianhydride | phenoxathein | |
| 7 | Resorcinol-bis--(3,4-dicarboxy-phenyl) ester dianhydride | 4,4'-diamino-paraterphenyl | 120 |

| Number | Percentage elongation at rupture, % | Elastic modulus, kgf/sq. mm | Heat stability at 450° C., % |
|---|---|---|---|
| 1 | 1.6/1.3 | 13000/16000 | 27.2 |
| 2 | 1.6/1.2 | 10800/12700 | 27.1 |
| | 1.4 | 11200 | — |
| | 1.7 | 10200 | — |
| 3 | 1.3 | 11000 | — |
| | 1.3 | 11000 | — |
| 4 | 1.7 | 8000 | — |
| 5 | 1.8 | 7800 | — |
| 6 | 2.0 | 7800 | — |
| 7 | 1.5 | 12300 | — |

TABLE 2

Characteristics of polyimide fibres

| Characteristic | Examples | | | |
|---|---|---|---|---|
| 1 | 1<br>2 | 2<br>3 | 3<br>4 | 4<br>5 |
| Strength, cN/tex | 60 | 60 | 80 | 160 |
| Percentage elongation at rupture, % | 10 | 10 | 10 | 3.5 |
| Elastic modulus, kgf/sq, mm | 1500 | 1500 | 2500 | 12000 |
| Oxygen index, % | 50 | 52 | 65 | 75 |
| Density, g/cu. cm | 1.43 | 1.43 | 1.45 | 1.54 |
| Thermal conductivity, W/m. deg | 0.077 | 0.077 | 0.067 | 0.060 |
| Equilibrium moisture content with 65% relative humidity, % | 1.0 | 1.0 | 1.5 | 1.20 |
| Shrinkage in boiling water, % | 0 | 0 | 0 | 0 |
| Shrinkage in the air at 300° C., % | 0.2 | 0.2 | 0.5 | 0.5 |
| Fumes releasing when exposed to open fire, % | 1.0 | 1.0 | 1.0 | 1.0 |
| Static exchange capacity index, mg-eg/g | 3.82 | 3.82 | 4.52 | 4.6 |

| Characteristic | Examples | | | |
|---|---|---|---|---|
| 1 | 5<br>6 | $6A_1$<br>7 | $6A_2$<br>8 | 6B<br>9 |
| Strength, cN/tex | 170 | 110 | 110 | 145 |
| Percentage elongation at rupture, % | 2.0 | 1.66 | 1.66 | 1.4 |
| Elastic modulus, kgf/sq, mm | 23000 | 13000 | 13000 | 16000 |
| Oxygen index, % | 55 | 38 | 40 | 60 |
| Density, g/cu. cm | — | 1.41 | 1.41 | 1.42 |
| Thermal conductivity, W/m. deg | 0.065 | — | — | — |
| Equilibrium moisture content with 65% relative humidity, % | 1.22 | 1.2 | 1.2 | 1.2 |
| Shrinkage in boiling water, % | 0.2 | 0.3 | 0.3 | 0.2 |
| Shrinkage in the air at 300° C., % | 0.6 | 1.5 | 1.5 | 1.0 |
| Fumes releasing when exposed to open fire, % | 1.0 | 1.0 | 1.0 | 1.0 |
| Static exchange capacity index, mg-eg/g | 4.58 | — | — | 3.2 |

TABLE 2-continued

Characteristics of polyimide fibres

| 1 | 2 | 3 | 4 | 5 |
|---|---|---|---|---|
| Heat stability, % after heating at 300° C. in the air for 100 hours | 80 | 88 | 80–85 | 70–80 |
| Same, at 350° C. for 100 hours | — | — | — | — |
| Strength at a temperature of liquid nitrogen (−195° C.), cN/tex | 90 | 93 | 100 | 200 |
| Maximum prolonged-operation temperature | 320 | 330 | 350 | 320 |
| Fibre phosphorus content, wt. % | 0.50–0.55 | 0.50–0.55 | 0.60–0.65 | 0.90–1.00 |

| 1 | 6 | 7 | 8 | 9 |
|---|---|---|---|---|
| Heat stability, % after heating at 300° C. in the air for 100 hours | 90 | 54 | 59 | 88 |
| Same, at 350° C. for 100 hours | 82 | — | — | — |
| Strength at a temperature of liquid nitrogen (−195° C.), cN/tex | 200 | 140 | 150 | 150 |
| Maximum prolonged-operation temperature | 350 | 250 | 265 | 300 |
| Fibre phosphorus content, wt. % | 0.80–0.85 | — | — | 0.80–0.85 |

TABLE 3

Mechanical, thermal, and fire-protection properties of fibres

| Fibre specimen | Strength, cN/tex | Percentage elongation at rupture | Elastic modulus, kgf/sq. mm | Oxygen index, % |
|---|---|---|---|---|
| I A | 107 | 1.6 | 12500 | 38 |
| I B | 110 | 1.5 | 13500 | 57 |
| II A | 115 | 1.5 | 14500 | 38 |
| II B | 145 | 1.4 | 16000 | 60 |

| Fibre specimen | Thermal stability, % | | Heat resistance | Strength at |
|---|---|---|---|---|
| | 300° C. 100 h | 350° C. 100 h | at 450° C., % | −196° C., cN/tex |
| I A | 65 | 54 | 27.5 | 135 |
| I B | 80 | 78 | 28.0 | 141 |
| II A | 68 | 52 | 30.5 | 147 |
| II B | 88 | 85 | 29.5 | 184 |

TABLE 4

Stability factor of properties

| Characteristics | Examples | | | | | | | |
|---|---|---|---|---|---|---|---|---|
| | 1 | 2 | 3 | 4 | 5 | $6A_1$ | $6A_2$ | 6B |
| Strength, cN/tex | 0 | 0 | 0 | 0 | 0 | 0.125 | 0.125 | 0.12 |
| Percentage elongation at rupture, % | 0 | 0 | 0 | 0 | 0 | 0.162 | 0.162 | 0.162 |
| Elastic modulus, | 0 | 0 | 0 | 0 | 0 | 0.3 | 0.29 | 0.25 |

TABLE 4-continued

| Stability factor of properties | | | | | | | | |
|---|---|---|---|---|---|---|---|---|
| | Examples | | | | | | | |
| Characteristics | 1 | 2 | 3 | 4 | 5 | $6A_1$ | $6A_2$ | 6B |
| kgf/sq. mm | | | | | | | | |
| Oxygen index, % | 0 | 0 | 0 | 0 | 0 | 0.09 | 0.08 | 0.07 |
| Thermal stability, % | 0 | 0 | 0 | 0 | 0 | 0.06 | 0.04 | 0.05 |

We claim:

1. A process for producing polyimide fibers comprising the steps of:

preparing a polyamide acid solution in an aprotic amide solvent in the course of synthesis;

spinning said polyamide acid solution in an aqueous-organic settling bath;

drafting said fibers to plasticize them;

washing said fibers until a 2–4 wt. % content of the residual solvent is attained;

treating said fibers with a solution of an organic or inorganic acid until a 0.5–1.0 wt. % content of the solvent in the fiber is attained; and drying and heat-treating said fibers.

2. A process for producing polyimide fibers as set forth in claim 1, wherein an organic acid selected from the group consisting of benzoic acid, nicotinic acid and iso-nicotinic acid is used as said organic acid, and an inorganic acid selected from the group consisting of phosphoric acid, hydrochloric acid, and boric acid is used as said inorganic acid.

3. A process for producing polyimide fibers as set forth in claim 1, wherein heat-treatment is carried out by an intermittent or a continuous technique in two stages.

4. A process for producing polyimide fibers as set forth in claim 3, wherein said first stage of the heat-treatment procedure by the intermittent technique is carried out in an air atmosphere, and said second stage is, under vacuum at a temperature gradually rising from 0° C. to 350° C.

5. A process for producing polyimide fibers as set forth in claim 3, wherein said first stage of the heat-treatment procedure by the continuous technique is performed in a tube in the medium of atmospheric air at a temperature of up to 250° C., and said second stage is, in an inert medium at a temperature of 500° C.–600° C. in a tubular temperature-controlled chamber, the outlet temperature of said chamber being 250°–400° higher than the inlet temperature thereof.

* * * * *